United States Patent [19]

Mancusi

[11] 4,445,616

[45] May 1, 1984

[54] CARGO CONTAINER WITH ADJUSTABLE RETAINING MECHANISM

[75] Inventor: Fred Mancusi, Kenosha, Wis.

[73] Assignee: American Motors Corporation, Southfield, Mich.

[21] Appl. No.: 385,366

[22] Filed: Jun. 7, 1982

[51] Int. Cl.[3] ..... A47F 1/00

[52] U.S. Cl. ..... 211/13; 312/323; 108/55.1

[58] Field of Search ..... 211/41; 108/55.1, 55.3; 312/322, 323, 193, 257, 350; 206/451; 410/150, 135; 280/47.34

[56] References Cited

U.S. PATENT DOCUMENTS

| | | | |
|---|---|---|---|
| 1,108,893 | 9/1914 | Ellinwood | 312/323 X |
| 1,480,043 | 1/1924 | Blakeslee | 211/41 X |
| 1,518,497 | 12/1924 | Flood | 108/55.1 X |
| 1,867,907 | 7/1932 | Dawson | 312/323 |
| 2,359,406 | 10/1944 | Crosser | 108/55 |
| 3,240,351 | 3/1966 | Weiss et al. | 108/55.1 X |

FOREIGN PATENT DOCUMENTS

| | | | |
|---|---|---|---|
| 464167 | 4/1950 | Canada | 410/150 |
| 605390 | 9/1960 | Canada | 410/130 |

*Primary Examiner*—Ramon S. Britts
*Assistant Examiner*—Sarah A. Lechok
*Attorney, Agent, or Firm*—Brooks & Kushman

[57] ABSTRACT

A cargo container is disclosed having a pair of parallel, spaced, longitudinally extending side rails, each of which having a sliding track formed along the longitudinal axis of the slide rails and an adjustable rail structure extending between the side rails and slidably adjustable on the tracks between an access position to permit loading and unloading of freight within the container and a variable retaining position to permit retention of the freight within the container. The adjustable rail structure includes a pair of slide members and an interconnecting retaining bar connected therebetween. Each of the slide members includes inner and outer hinged slide portions wherein the retaining bar is connected to the outer slide portions. The inner and outer slide portions pivot with respect to each other upon movement of the retaining bar between the access and storage positions. Stop members connected on the side rails and their inner slide portions prevent movement of the inner slide portions out of their track in the access position.

7 Claims, 3 Drawing Figures

10
12
14
16
18
20
24
28
52

12
14
16
18
26
28
30
32
36
42

16
22
26
28
30
32
34
36
38
40
42
44
46
48
50

CARGO CONTAINER WITH ADJUSTABLE RETAINING MECHANISM

TECHNICAL FIELD

This invention relates to material handling apparatus and has particular utility in connection with an automobile assembly operation.

BACKGROUND ART

In a manufacturing operation using an assembly line procedure the operation is supported by the regular supply of assembly parts to work stations alongside the assembly line. If the assembly parts are large articles or sub-assemblies, it is common to transport such parts in movable racks or cargo containers in which the parts are carried in an ordered array. The rack usually includes a retaining mechanism or rail structure for holding the parts in position and securing them from impact while in transit. The retaining mechanism also permits loading and unloading of the parts from the rack.

In a rack typical of the type used for a large scale manufacturing operation, e.g. automotive assembly, the retaining mechanism may be in the form of a bar or similar restraint. A problem encountered with known storage racks in such an environment is the need to disassemble, remove and reassemble the retaining mechanism with each supply cycle. This requirement yields certain practical disadvantages, i.e., it is an inefficient use of worker time and there is a tendency to misplace and mishandle the retaining mechanism causing loss, damage and inconvenience.

DISCLOSURE OF THE INVENTION

The present invention is an improvement in design of material handling racks and similar apparatus and presents a solution to the practical problems identified in the preceding paragraph. More specifically, the material handling rack embodying the present invention may comprise a frame structure with a bed or floor for supporting the assembly parts. The floor and certain members of the frame may be shaped or configured in a form complimentary to that of the parts to be carried on the rack.

The retaining mechanism may take the form of a bar or member connected to the frame and movable between a hold or retaining position and a release or access position. In the hold position, the bar is positioned adjacent the array of parts carried on the rack and secures and protects them against displacement and impact while in transit. In the release position, the bar or member is moved away from the parts on the rack to a non-interfering position which permits workers to load the parts onto the rack off-line or to allow assemblers to unload the parts when the rack is stationed on-line.

A feature of the present invention is the mechanism which controls the travel of the retaining member between the hold position and the release position. In operation, the retaining member is moved from the hold position to the release position by first retracting it from its position adjacent to the parts by a sliding motion, and second by dropping it downwardly to the release position by a pivotal motion so that it does not interfere with loading or unloading of the part. The sequence is reversed for movement of the retaining mechanism between the release position and the hold position.

The sliding motion is obtained by tracks formed in side rails of the frame and slide members which travel within the tracks. The pivotal motion is obtained by a hinged connection formed in the slide which is operative when the side is withdrawn or retracted a predetermined distance from the tracks.

The present invention gives several advantages over the known art. The retaining mechanism may be moved between positions by two simple, efficient motions. The retaining bar or similar restraint means is connected to the rack in its release position and opportunity for mishandling or misplacement of the bar or restraint is lessened.

Other advantages of the present invention will be readily appreciated as the same becomes better understood by reference to the following detailed description of the best mode when considered in connection with the accompanying drawings.

BEST MODE FOR CARRYING OUT THE INVENTION

Figure 1:
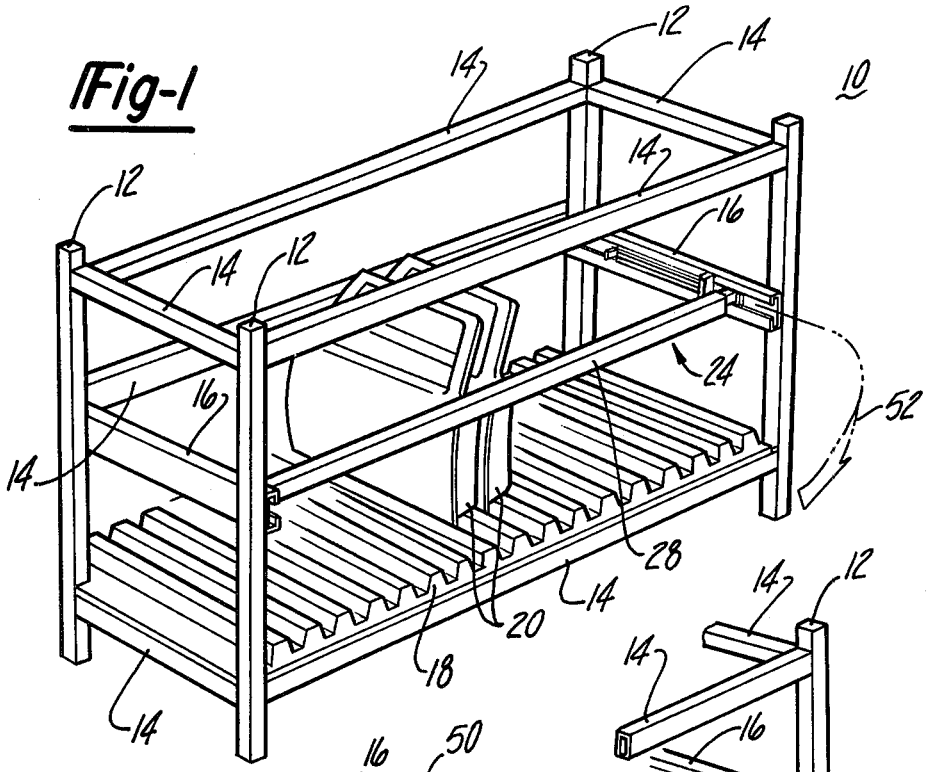
FIG. 1 is a perspective view of a cargo container constructed in accordance with the present invention in its retaining position for retaining freight.

Referring to FIG. 1, a cargo container constructed according to the present invention is indicated collectively by reference numeral 10 and comprises a generally rectangular frame structure including four spaced apart vertical frame members 12, a plurality of interconnecting horizontal frame members 14 and a pair of spaced, parallel, longitudinally extending side rails 16 positioned at opposite sides of the cargo container 10. The cargo container 10 also includes a support or bed structure 18 which is shaped or configured in a form complementary to that of the parts to be carried in the cargo container 10 such as door panels 20 as shown in FIG. 1.

Figure 3:
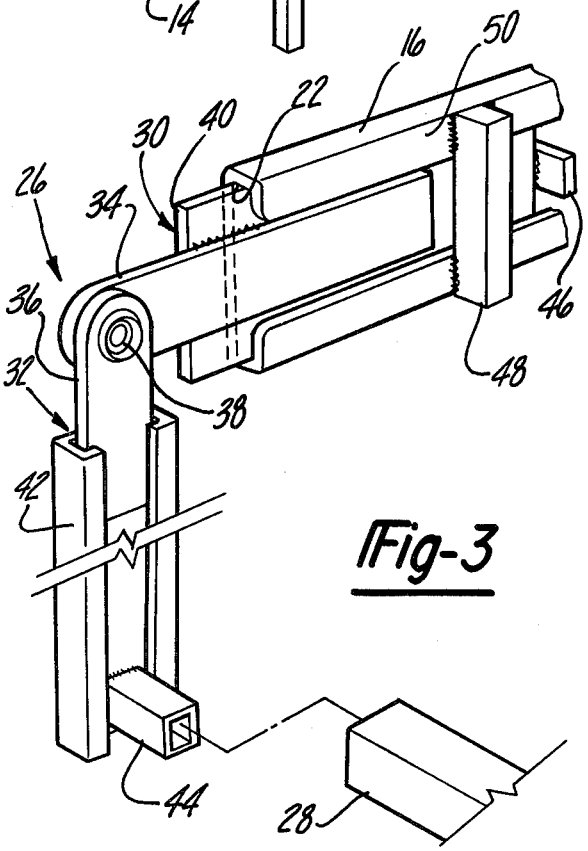
FIG. 3 is an enlarged perspective view, partially broken away and in cross-section, of the sliding mechanism of the present invention.

As best shown in FIG. 3, a sliding track 22 is formed within each of the slotted side rails 16. The sliding tracks 22 preferably extend the entire longitudinal length of the side rails 16 and are positioned above the top surface of the support structure 18 to permit sliding adjustment of an adjustable rail structure generally indicated at 24.

Figure 2:
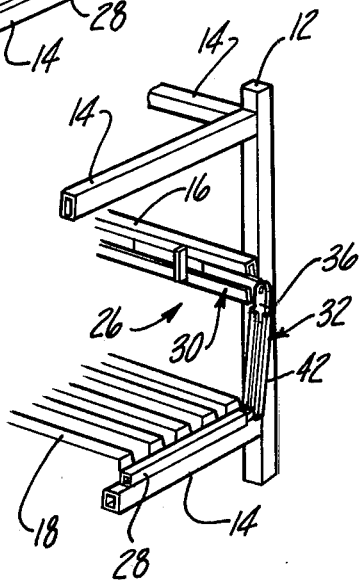
FIG. 2 is a view, partially broken away and in cross-section, of the cargo container and its access position.

The adjustable rail structure 24 extends between the side rails 16 and is slidably adjustable on the tracks 22 between an access position as shown in FIG. 2 to permit loading and unloading of freight within the cargo container 10 and a variable retaining position as shown in FIG. 1 to retain the freight within the cargo container 10.

The adjustable rail structure 24 includes a pair of slide members generally indicated at 26 in FIGS. 2 and 3 and an interconnecting retaining bar 28 which is adapted to retain the freight 20 within the cargo container 10. Each of the slide members 26 includes inner and outer hinged slide portions 30 and 32, respectively. In the retaining position of the rail structure 24, both the inner and outer slide portions 30 and 32 are slidably disposed within the track 22. In the access position of the rail structure 24 only the inner slide portions 30 are slidably retained within the track 22.

The slide portions 30 and 32 include elongated metal plates 34 and 36, respectively, which are pivotally secured together by a pivot 38. The inner and outer slide portions 30 and 32, respectively, also include inner and outer slide channels 40 and 42, respectively, which are welded to their corresponding plates 34 and 36 to permit the slide portions 30 and 32 to slide within the tracks 22 of the side rails 16.

At the end of each outer slide member 32 opposite the pivot 38, a tubing 44 having a square cross-section, is fixedly secured such as by welding, to the plate 36. A retaining bar 28 which is hollow and is also square in cross-section fits over each of the square tubings 44 when assembled to the slide members 26.

At the end of the inner slide portion 30 opposite the pivot 38 there is fixedly secured, such as by welding, a first stop member 46 which is adapted to engage a second stop member 48 which is welded to the inwardly facing, exterior surface 50 of the side rail 16 to prevent removal of the slide members 26 from the side rails 16 in the access position of the adjustable rail structure 24.

In operation, the retaining bar 28 is positioned adjacent the array of parts such as the freight 20 carried on the support structure 18 to secure and protect the freight 20 against impact and displacement while in transit. In this securing and protecting position the rail structure 24 is set to be in the retaining position.

In order to place the retaining bar 28 in the release or access position to enable workers to load parts onto the support structure 20 off-line or to allow assemblers to unload the freight 20 when the cargo container 10 is stationed on-line, the slide members 26 are first slid outwardly by gripping the retaining bar 28 until the outer slide portions 32 have been displaced completely out of the slotted rails 16. Then the outer slide portions 32 are dropped downwardly to the access position through a pivotal motion shown by arrow 52 in FIG. 1. The sequence is reversed for movement of the rail structure 24 between the access position and the retaining position. In this way the rail structure 24 can be moved between retaining and access positions by two simple efficient motions.

The retaining bar 28 always remains connected to the remainder of the cargo container 10 in its access position, thereby minimizing opportunity for mishandling or misplacing the retainer bar 28.

While a preferred embodiment of the invention has been shown and described herein in detail, those skilled in this art will recognize various alternative designs and embodiments for practicing the present invention as defined by the following claims.

What is claimed is:

1. A cargo container adapted to receive and retain freight therein, the container comprising a generally rectangular frame structure including:

a pair of parallel, spaced, longitudinally extending side rails positioned at opposite sides of the frame structure, each of the side rails having a sliding track formed along the longitudinal axis of the side rails, and an adjustable rail structure extending between said side rails and slidably adjustable on said tracks between an access position to permit loading and unloading of freight within the container and a variable retaining position to permit retention of the freight within the container wherein said rail structure is supported and retained on said side rails in both of said access and retaining positions.

2. The container as claimed in claim 1 wherein said adjustable rail structure includes a pair of slide members and an interconnecting retaining bar connected therebetween, said retaining bar adapted to retain the freight within the container.

3. The container as claimed in claim 2 wherein each of said slide members includes inner and outer hinged slide portions, said retaining bar being connected to the outer slide portion, said inner and outer slide portions being disposed on said tracks in said retaining position, said inner and outer slide portions pivoting with respect to each other upon movement between said access and said retaining positions to permit the retaining bar to move along the longitudinal axis and then along an axis perpendicular to the longitudinal axis to permit loading and unloading of the container.

4. The container as claimed in claim 1 or claim 2 or claim 3 wherein the sliding track is formed within each of the side rails.

5. The container as claimed in claim 3, including at least one stop member connected on one of said side rails and said slide members to prevent movement of said inner slide portion out of its track in said access position.

6. A cargo container for carrying one or more articles in stored positions comprising:

a frame structure;

a support structure connected to the frame structure, for supporting the articles in their stored positions; and an adjustable retaining rail structure connected to the frame structure and movable between an access position for loading and unloading of the articles, and a retaining position for retaining the articles in their stored positions, the retaining rail structure including, a retaining bar which in the retaining position limits displacement of the articles from their stored positions, and in the access position permits free movement of the articles from their stored positions, at least one slide member, interconnecting the retaining bar and the frame structure for providing sliding movement of the retaining bar in travel between the access position and the retaining position, wherein said slide member is supported and retained on said frame structure in both of said access and retaining positions, and at least one hinge mechanism cooperative with the slide member for providing pivotal movement of the retaining bar in travel between the access position and the retaining position.

7. In combination with a material handling device having a frame structure on which a plurality of articles are stored, a retaining mechanism movable between a first access position to permit loading and unloading of the articles and a second retaining position to retain the articles in their stored positions, comprising:

a retaining bar which in the retaining position limits displacement of the articles from their stored positions, and in the access position permits free movement of the articles from their stored positions, at least one slide member, interconnecting the retaining bar and the frame structure for providing sliding movement of the retaining bar in travel between the access position and the retaining position, wherein said slide member is supported and retained on said frame structure in both of said access and storage positions, and at least one hinge mechanism, cooperative with the slide member for providing pivotal movement of the retaining bar in travel between the access position and the retaining position.

* * * * *